US005884914A

United States Patent [19]

Lilien

[11] Patent Number: 5,884,914

[45] Date of Patent: Mar. 23, 1999

[54] INDOOR BASEBALL BOARD GAME

[76] Inventor: Mitchell Lilien, 905 Ross St., B-5Rahway, N.J. 07065-2139

[21] Appl. No.: 921,221

[22] Filed: Aug. 27, 1997

Related U.S. Application Data

[63] Continuation-in-part of Ser. No. 642,947, May 6, 1996.

[51] Int. Cl.[6] ..... A63F 7/06

[52] U.S. Cl. ..... 273/244.1; 273/244.2; 273/259

[58] Field of Search ..... 273/244.1, 244.2, 273/298, 146, 259

[56] References Cited

U.S. PATENT DOCUMENTS

| | | | |
|---|---|---|---|
| 2,742,290 | 4/1956 | Fasana | 273/298 |
| 3,734,501 | 5/1973 | La Monica . | |
| 4,261,569 | 4/1981 | Frohlich . | |
| 4,378,115 | 3/1983 | Terrero | 273/244.2 |
| 4,776,593 | 10/1988 | Di Persio et al. . | |
| 5,145,173 | 9/1992 | Crowder . | |
| 5,390,933 | 2/1995 | Kraus | 273/244.2 |
| 5,407,204 | 4/1995 | Meyer, III . | |

*Primary Examiner*—William M. Pierce

[57] ABSTRACT

An indoor baseball board game including a game board having two front corners and a central region, a baseball diamond being imprinted upon the central region of the board; two dugouts each being formed in a planar rectangular configuration and positioned adjacent to a front corner of the game board; a plurality of base runner tokens; chance determining means for producing a random output count; and a plurality of action cards, each card having a face and a back, the face of each card including indicia indicating the course of play, the back of each card including the words ACTION CARDS imprinted thereupon.

1 Claim, 4 Drawing Sheets

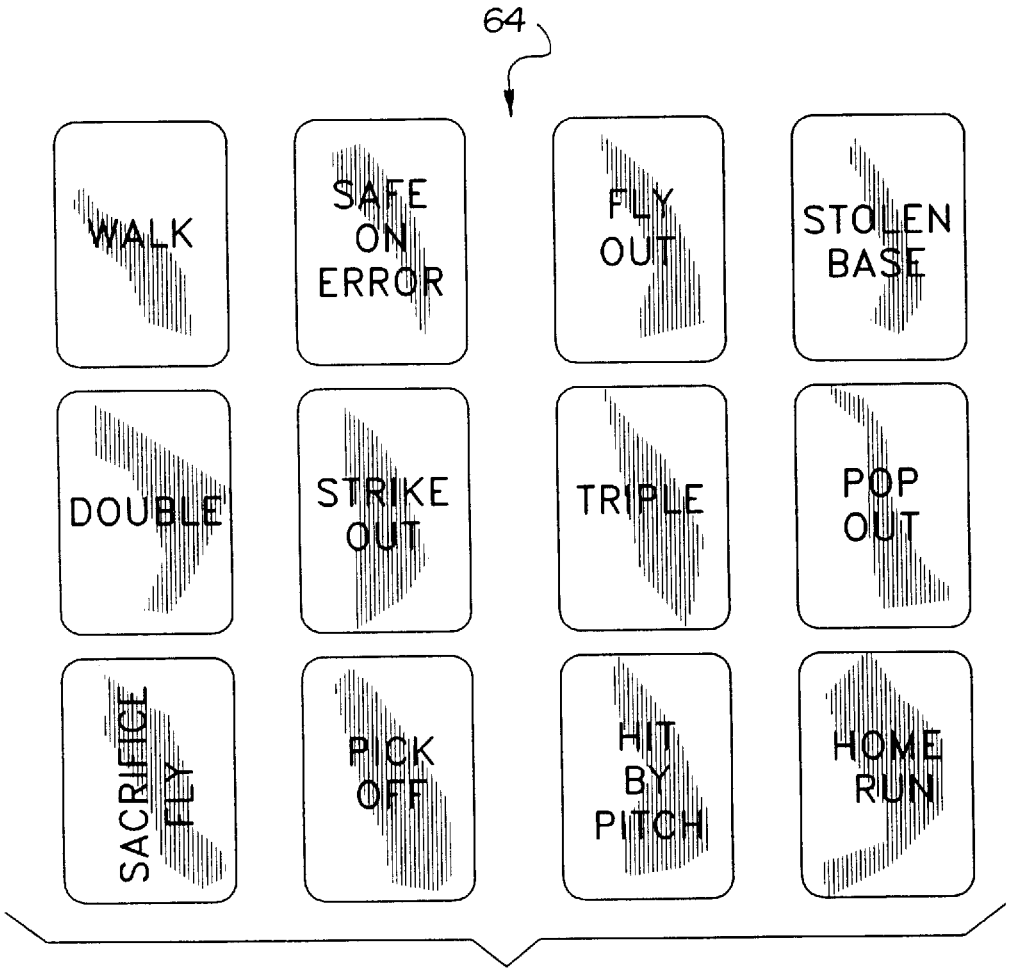
FIG. 9
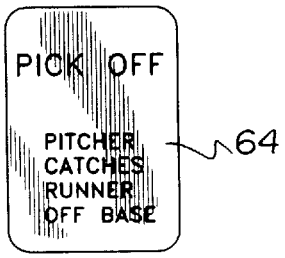
FIG. 10
FIG. 11
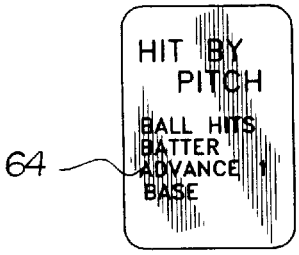

INDOOR BASEBALL BOARD GAME

This application is a continuation-in-part of an application filed May 6, 1996 under Ser. No. 08/642,947.

BACKGROUND OF THE INVENTION

1. Field of the Invention

The present invention relates to a indoor baseball board game and more particularly pertains to providing a unique method of playing an indoor baseball board game which simulates real play of a baseball game.

2. Description of the Prior Art

The use of baseball related board games is known in the prior art, More specifically, baseball related board games heretofore devised and utilized for the purpose of entertaining users by playing the games in the suggested manner are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,415,412 to McMahon discloses an apparatus for determining batting and base stealing outcomes in a baseball board game. U.S. Pat. No. 4,261,569 to Frohlich discloses a baseball board game. U.S. Pat. No. 5,280,912 to Porter discloses a baseball game apparatus. U.S. Pat. No. 4,687,199 to Aguirregomezcorta; U.S. Pat. No. 4,452,453 to Daley et al.; and U.S. Pat. No. 4,378,115 to Terrero each disclose a baseball game.

While these devices fulfill their respective, particular objective and requirements, the aforementioned patents do not describe an indoor baseball board game for specifically simulating the play of a professional baseball game.

SUMMARY OF THE INVENTION

The present invention essentially comprises a method of playing an indoor baseball board game including the steps of: providing a game board formed in a generally rectangular configuration with essentially linear front, rear and side edges, the game board having two front corners, two rear corners and an upper face with a central region, each side edge having an approximate center point; providing a baseball diamond being imprinted upon the central region of the board, the baseball diamond including three rectangular bases positioned adjacent to the respective center points of the rear edge and side edges, the baseball diamond including a pentagonally shaped home plate positioned adjacent to the center point of the front edge, two generally rectangular batter's boxes being positioned on opposites sides of home plate, a linear base line being positioned between adjacent bases to form a diamond shaped configuration, a circle representing a pitchers mound being positioned at the center point of the baseball diamond, a line representing a pitching rubber being imprinted within the circle; providing two dugouts each being formed in a planar generally rectangular configuration with an upper surface, a long front edge, a long rear edge and two short side edges, each dugout being positioned adjacent to a front corner with its front edge being positioned parallel to two base lines, the axis of the front edge of each dugout intersecting the approximate center point of the front edge and a side edge of the board at about a forty five degree angle; providing a plurality of base runner tokens each including an upper ball, a lower base and a central section, the central section including a flange positioned therearound below the upper ball, the diameter of each lower base measures about ninety percent of the diameter of the circular recesses of the dugout; providing a random number selection means for generating a pair of numbers; providing a plurality of action cards, each card having a face and a back, the face of each card including a plurality of indicia indicating the course of play, the back of each card including the words ACTION CARDS imprinted thereupon, whereby the number of action cards including each indica is predetermined to simulate realistic play; providing an instruction booklet including the rules of play and object of the game; providing a score pad including means to record numerical results from play of the game; providing a pair of line-up card including indicia representative of the base runner tokens; placing a base runner token at home plate; generating a pair of numbers with the random number selection means simultaneously by both an offensive player and a defensive player; giving the base runner token a strike upon the number generated by the defensive player totaling higher than that of the offensive player wherein three strikes render the base runner token out; selecting an action card by the offensive player upon the number generated by the defensive player totaling less than that of the offensive player, whereby the current base runner is maneuvered over the bases in accordance with the indicia indicating the course of play on the action card; advancing the current base runner token an extra base upon the selecting of an action card by the offensive player which allows the advancing of at least one base, whereby the current base runner token is advanced only upon generating a number with the random number selection means simultaneously by both the players and the number of the defensive player totaling less than that of the offensive player; rendering a base runner out only upon the selecting of an action card with indicia indicating "PICK OFF" and upon generating a number with the random number selection means simultaneously by both the players wherein the number of the defensive player totals more than that of the offensive player; and recording on the line-up scorecard the indicia on the action card next to the indica representative of the current base runner token thereby tracking the course of play of each base runner token.

It is therefore an object of the present invention to provide a new and improved indoor baseball board game which has all the advantages of the prior art baseball related board games and none of the disadvantages.

Still yet another object of the present invention is to provide a new and improved indoor baseball board game which provides in the apparatuses and methods of the prior art some of the advantages thereof, while simultaneously overcoming some of the disadvantages normally associated therewith.

Still another object of the present invention is to provide a unique method of playing an indoor baseball board game which simulates real play of a baseball game.

Lastly, it is an object of the present invention to provide a new and improved indoor baseball board game including a game board having two front corners and a central region, a baseball diamond being imprinted upon the central region of the board; two dugouts each being formed in a planar rectangular configuration and positioned adjacent to a front corner of the game board; a plurality of base runner tokens; chance determining means for producing a random output count; and a plurality of action cards, each card having a face and a back, the face of each card including indicia indicating the course of play, the back of each card including the words ACTION CARDS imprinted thereupon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the indoor baseball board game constructed in accordance with the principles of the present invention.

FIG. 9 illustrates a perspective view of the different types of action cards positioned in a face up orientation.

FIG. 10 illustrates a perspective view of a "pick off" action card positioned in a face up orientation.

FIG. 11 illustrates a perspective view of a "hit by pitch" action card positioned in a face up orientation.

Similar reference characters refer to similar parts throughout the several views of the drawings.

DESCRIPTION OF THE PREFERRED EMBODIMENT

Figure 1:
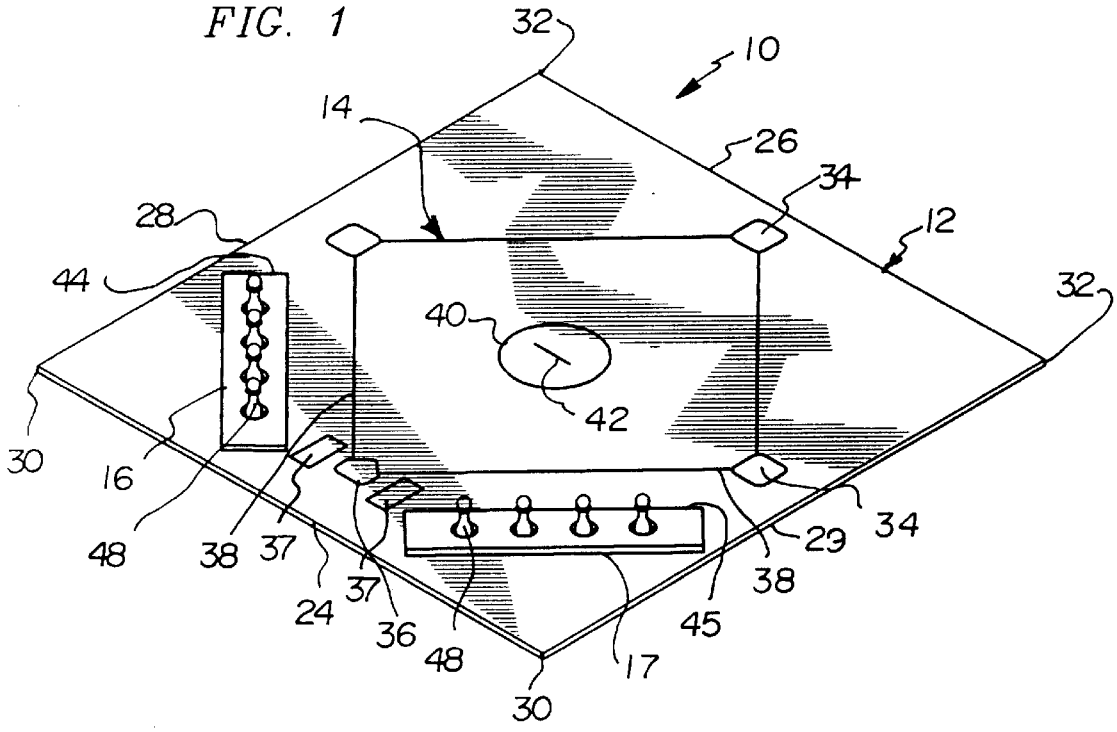
FIG. 1 is a perspective illustration of the preferred embodiment of the indoor baseball board game constructed in accordance with the principles of the present invention.

With reference now to the drawings, and in particular, to FIG. 1 thereof, the preferred embodiment of the new and improved indoor baseball board game embodying the principles and concepts of the present invention and generally designated by the reference number 10 will be described.

Specifically, it will be noted in the various Figures that the device relates to an indoor baseball board game 10. In its broadest context, the device consists of a game board 12, a baseball diamond 14, two dugouts 16, 17, base runner tokens 18, four dice 20 and action cards 22. Such components are individually configured and correlated with respect to each other so as to attain the desired objective.

The game board 12 is fabricated of green felt material and formed in a generally rectangular configuration with essentially linear front 24, rear 26 and side edges 28, 29. The game board has two front corners 30, two rear corners 32 and an upper face with a central region. Each side edge has an approximate center point. Note FIG. 1.

The baseball diamond 14 is imprinted upon the central region of the board. The baseball diamond includes three rectangular shaped bases 34 positioned adjacent to the respective center points of the rear edge and side edges. The baseball diamond includes a pentagonally shaped home plate 36 positioned adjacent to the center point of the front edge. Two generally rectangular batter's boxes 37 are positioned on opposite sides of home plate in a generally parallel orientation. A linear base line 38 is positioned between adjacent bases to form a diamond shaped configuration defining the boundaries of the baseball diamond. A circle representing a pitchers mound 40 is positioned at the center point of the baseball diamond. A line 42 representing a pitching rubber is imprinted within the circle. Note FIG. 1.

First and second dugouts 16, 17 are each formed in a planar generally rectangular configuration with an upper surface, a long front edge 44, 45, a long rear edge and two short side edges. The dugouts have a thickness greater than the thickness of the game board. The upper surface of each dugout includes four circular recesses 48 extending within them. The base runner tokens 18 are positioned within the recesses at the start of the game. During play of the game the tokens are positioned upon the bases as dictated by the action cards. Note FIG. 1.

Figure 2:
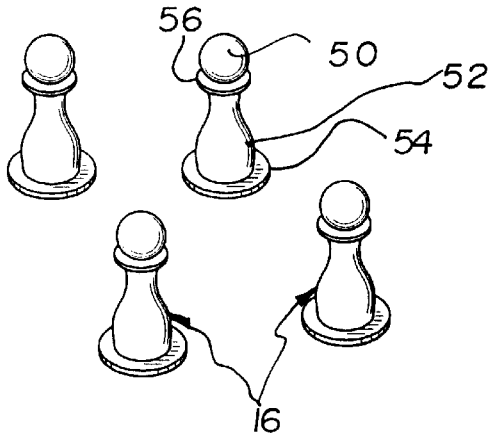
FIG. 2 is a perspective view of the base runner tokens of the apparatus.

Each dugout is positioned adjacent to a front corner with its front edge positioned parallel to two base lines. The axis of the front edge of a first dugout 16 intersects the approximate center point of the front edge 24 and side edge 28 of the board at about a forty five degree angle. The axis of the front edge of a second dugout 17 intersects the approximate center point of the front edge 24 and side edge 29 of the board at about a forty five degree angle. If a perpendicular line were drawn from the center point of the rear edge of each dugout it would intersect each front corner 30. This symmetrical arrangement simulates the structure of a professional baseball field. Note FIGS. 1 and 2.

Eight base runner tokens 18 each include an upper ball 50, a lower base 52 and a central section 54. The central section includes a flange 56 positioned around it below the upper ball. The flange facilitates gripping of the tokens by a user. The diameter of each lower base measures about ninety percent of the diameter of the circular recesses 48 of the dugout. Note FIGS. 1 and 2. In the alternative, the circular recesses may be excluded and the dugouts rendered flat. Four of the base runner tokens are of a first color and four of the base runner tokens are of a second color. It should be noted that each of the base runner tokens are differentiated by a unique number, name or the like. This is to allow tracking of batting statistics of each individual token.

Figure 3:
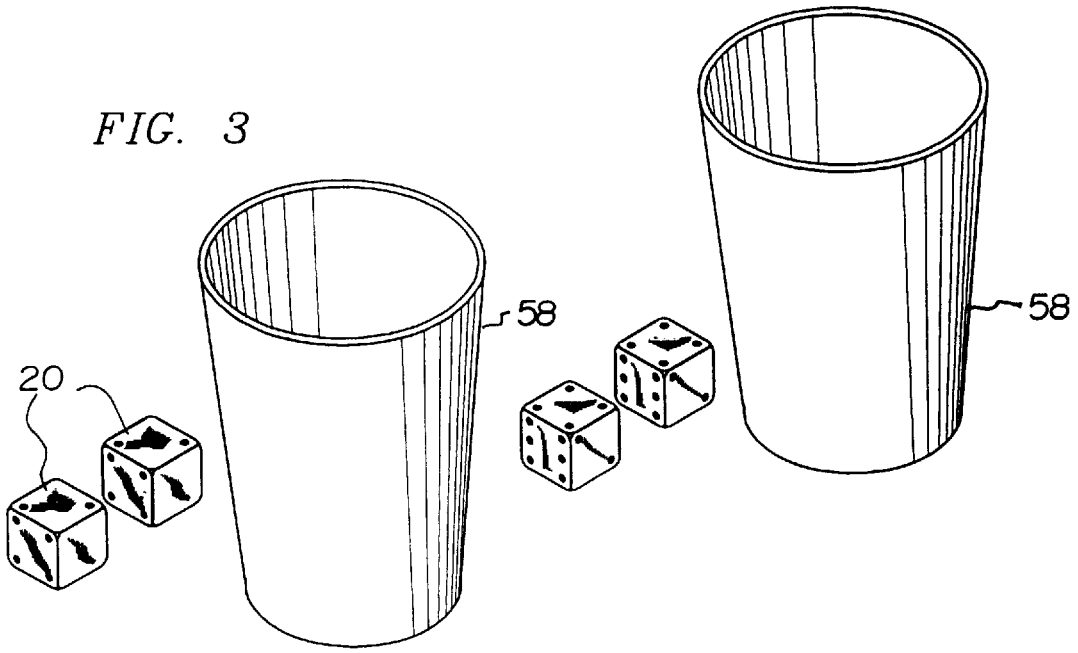
FIG. 3 is a perspective view of the dice and dice cup of the apparatus.

Four dice 20 each have six sides. Each side includes between one and six dots imprinted upon it. At the beginning of the game each player is assigned two dice. Two dice are one color and two dice are another color similar to the associated base runner tokens. Two dice cups 58 are formed in a hollow generally cylindrical configuration with an open top. Each dice cup is a different color to match the dice. During play of the game the dice are shaken within a cup and rolled upon the board. Note FIG. 3.

Figure 6:
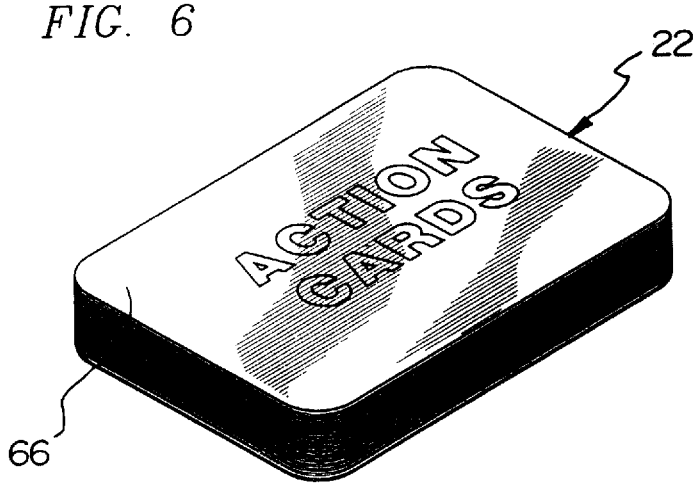
FIG. 6 is a perspective view of the action cards of the apparatus stacked in a face down orientation.
Figure 7:
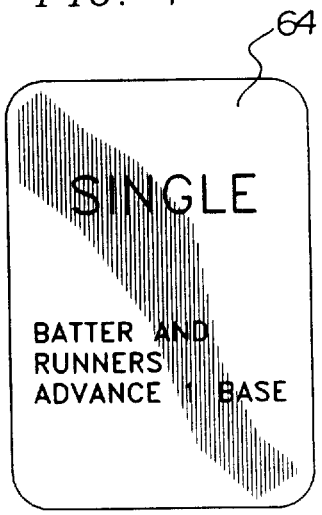
FIGS. 7 and 8 each illustrate perspective views of action cards positioned in a face up orientation.
Figure 8:
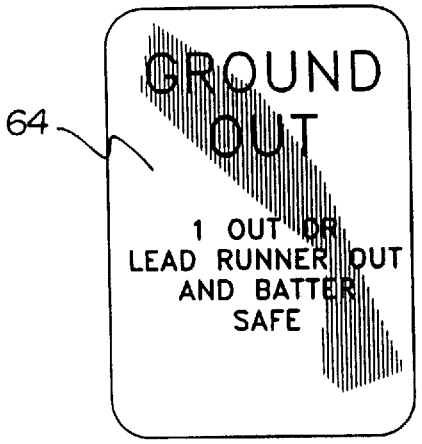

A plurality of action cards 22 are included with the apparatus. In alternate embodiments of the apparatus a spinner is used rather than the action cards. Each card has a face 64 and a back 66. The face of each card includes indicia indicating the course of play. The back of each card includes the indicia "ACTION CARDS" imprinted thereupon. Utilization of the "ACTION CARDS" is discussed below. Note FIGS. 6–8.

Figure 4:
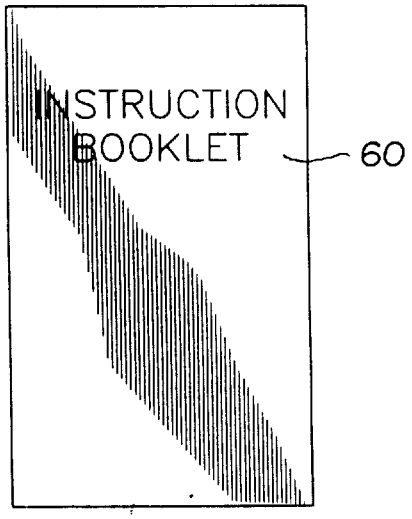
FIG. 4 is a perspective view of the instruction booklet of the apparatus.
Figure 5:
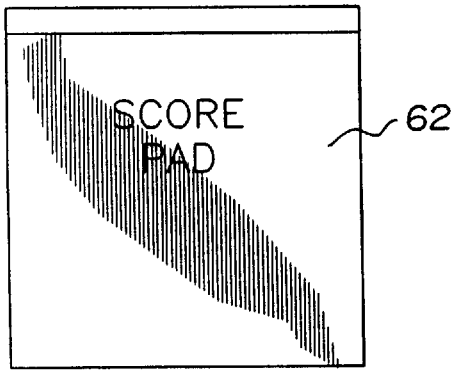
FIG. 5 is a perspective view of the score pad of the apparatus.

An instruction booklet 60 includes the rules of play and object of the game. A score pad 62 includes means to record numerical results from play of the game, a score card and score board. Note FIGS. 4 and 5. The rules of play are set forth below:

Introduction—The present invention is a very exciting game for 2 players. It enable 2 players to compete head to head for the championship.

Object of Game—To score more runs than your opponent in the regulation 9 innings with the home team batting last.

In Case of a Tie—Extra innings are played until the tie is broken.

Players and Equipment—Each game consists of a baseball playing field board, special "Action Playing Cards", a pair of line up scorecards, scoreboard, dice and cup, as well as 4 base runner tokens for each team.

Note—Each player selects his own lineup and pitcher and fills the names, in the form of indicia, on one of the line up scorecards in the order he wants the tokens to bat. After each time at bat a player can keep a record of each token regarding actions such as averages, home runs or stolen bases for the hitters. As an option, each player may track wins, losses, walks, strikeouts or ERA for pitchers.

Rules—After filling in each lineup, the visiting team bats first. Home team bats after 3 outs are recorded.

Batting—The offensive player puts a base runner token at home plate. Both players rolls their respective dice. If the dice of the player posing as pitcher, or defensive player, total to be higher that of the player posing as batter, or offensive player, it is a strike, 3 strikes equal 1 out. If the pitcher's total is the same amount, it is recorded as a foul ball. On the 3rd strike, if the total is the same amount, the players roll again. If the pitcher's total is lower than that of the batter, the player posing as batter selects an "Action Card."

"Action Cards"—To facilitate fair play, the defensive player shuffles cards after each ½ inning and randomly distributes the same to the offensive player. When selected, the Action Card determines the course of play. Specifically, the Action Cards govern the movement of a batter token and any runner tokens that might be on any of the bases. The specific number of each of the Action Cards indicated below is specifically chosen to simulate realistic play.

Single—Batter and runner tokens, if any, advance 1 base. Five single cards are included with the apparatus.

Double—Batter and runner tokens, if any, advance 2 bases. Four double cards are included with the apparatus.

Triple—Batter and runner tokens, if any, advance 3 bases. Two triple cards are included with the apparatus.

Home Run—Batter and runner tokens, if any, advance 4 bases. Three home run cards are included with the apparatus. Any batter or runner token crossing home plate scores 1 run and is returned to the dugout in the proper order in accordance with the line-up scorecard. It should be noted that the batter and runner tokens are also placed in order in the dugout when deemed out.

Walk—Advance batter token to 1st Base. If a runner token resides on 1st base already, such runner token advances 1 base also. Four walk cards are included with the apparatus.

Safe on Error—Defensive misplay. Batter token goes to 1st base and any existing runner tokens advance 1 base. Two safe on error cards are included with the apparatus.

Sacrifice Fly—Batter token is out. If runner tokens exist, only leading runner token moves up 1 base. Three sacrifice fly cards are included with the apparatus. With 2 outs already—scored as regular 3rd out.

Pop Out—Batter token is out with no runner tokens advancing. Four pop out cards are included with the apparatus.

Ground out—Leading runner token is out, if any, and batter token safe. Six ground out cards are included with the apparatus.

Fly out—Batter token is out. —Six fly out cards are included with the apparatus. On a Fly out, if at least one runner token is on base, the leading runner token can advance an extra base if the offensive player has less than 2 outs, as will be set forth hereinafter.

Strike Out—Batter token is out. It should be noted that the batter token can be called out on strikes without an action card as indicated hereinabove or if a card selected that indicates a foul tip held by catcher—1 out. No existing runners advance. Four strike out cards are included with the apparatus.

Stolen Base—Offensive player can only attempt a steal after selecting this action card and selecting a token to steal. If there are not any runner tokens, the offensive player merely picks again. Upon the selection of a runner token, the offensive player and defensive player both roll 1 die. If the defensive player rolls a higher amount, the selected runner token is out. A lower roll by the defensive player allows the selected token to advance 1 base. A separate die showing safe or out written on it may be used in the alternative to the conventional dice. Four stolen base cards are included with the apparatus. It should be noted that if runner tokens exist on first and third base, only the runner token on first base advances if the steal is successful. After the steal is deemed successful or not, the offensive player may pick again to move the batter token only if the number of outs allow it.

Pick off—The lead runner token is out. In other words, the pitcher throws to fielder who tags a runner off base. After the lead runner token is removed, the offensive player is permitted to pick again as long as the number of outs permit. If no runner tokens exits, the offensive player simply picks again. One pick off card is included with the apparatus.

Hit by Pitch—The batter token advances to 1st base. One hit by pitch card is included with the apparatus.

Wild Pitch—Any existing runner tokens advance one base and offensive player picks another action card.

Double Play—The lead runner token, if any, and the batter token are both deemed out.

After selecting an Action Card which permits the batter token to advance a predetermined amount of bases, the offensive player may opt to advance an extra base. To accomplish such, the offensive player and defensive player both roll 2 dice. If the defensive player rolls a higher amount, the batter token is out. Lower roll by the defensive player allows the batter token to advance an extra base.

With regard to scoring, after each roll, a ball, strike, out, or run is marked on the scoreboard. Batting results for each batter token is recorded on the line-up scorecard. This is for accuracy and to help the players determine records and averages of tokens throughout the game and series.

As a suggested option, players may select any major league team to represent. Each play may want to set up a league with friends and represent their favorite team in a schedule.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved method of playing an indoor baseball board game comprising the steps of:

providing a game board formed in a generally rectangular configuration with essentially linear front, rear and side edges, the game board having two front corners, two rear corners and an upper face with a central region, each side edge having an approximate center point;

providing a baseball diamond being imprinted upon the central region of the board, the baseball diamond including three rectangular bases positioned adjacent to the respective center points of the rear edge and side edges, the baseball diamond including a pentagonally shaped home plate positioned adjacent to the center point of the front edge, two generally rectangular batter's boxes being positioned on opposites sides of home plate, a linear base line being positioned between adjacent bases to form a diamond shaped configuration, a circle representing a pitchers mound being positioned at the center point of the baseball diamond, a line representing a pitching rubber being imprinted within the circle;

providing two dugouts each being formed in a planar generally rectangular configuration with an upper surface, a long front edge, a long rear edge and two short side edges, each dugout being positioned adjacent to a front corner with its front edge being positioned parallel to two base lines, the axis of the front edge of each dugout intersecting the approximate center point of the front edge and a side edge of the board at about a forty five degree angle;

providing a plurality of base runner tokens each including an upper ball, a lower base and a central section, the central section including a flange positioned therearound below the upper ball, the diameter of each lower base measures about ninety percent of the diameter of the circular recesses of the dugout;

providing a random number selection means for generating a pair of numbers;

providing a plurality of action cards, each card having a face and a back, the face of each card including a plurality of indicia indicating the course of play, the back of each card including the words ACTION CARDS imprinted thereupon, whereby the number of action cards including each indica is predetermined to simulate realistic play;

providing an instruction booklet including the rules of play and object of the game;

providing a score pad including means to record numerical results from play of the game;

providing a pair of line-up card including indicia representative of the base runner tokens;

placing a base runner token at home plate;

generating a pair of numbers with the random number selection means simultaneously by both an offensive player and a defensive player;

giving the base runner token a strike upon the number generated by the defensive player totaling higher than that of the offensive player wherein three strikes render the base runner token out;

selecting an action card by the offensive player upon the number generated by the defensive player totaling less than that of the offensive player, whereby the current base runner is maneuvered over the bases in accordance with the indicia indicating the course of play on the action card;

advancing the current base runner token an extra base upon the selecting of an action card by the offensive player which allows the advancing of at least one base, whereby the current base runner token is advanced only upon generating a number with the random number selection means simultaneously by both the players and the number of the defensive player totaling less than that of the offensive player;

rendering a base runner out only upon the selecting of an action card with indicia indicating "PICK OFF" and upon generating a number with the random number selection means simultaneously by both the players wherein the number of the defensive player totals more than that of the offensive player; and recording on the line-up scorecard the indicia on the action card next to the indica representative of the current base runner token thereby tracking the course of play of each base runner token.

* * * * *